US011273562B2

(12) United States Patent
Le

(10) Patent No.: US 11,273,562 B2
(45) Date of Patent: Mar. 15, 2022

(54) HAIR CUTTING DEVICE

(71) Applicant: Wayne N. Le, Garland, TX (US)

(72) Inventor: Wayne N. Le, Garland, TX (US)

( * ) Notice: Subject to any disclaimer, the term of this patent is extended or adjusted under 35 U.S.C. 154(b) by 0 days.

(21) Appl. No.: 17/374,944

(22) Filed: Jul. 13, 2021

(65) Prior Publication Data

US 2022/0009112 A1 Jan. 13, 2022

Related U.S. Application Data

(60) Provisional application No. 63/051,060, filed on Jul. 13, 2020.

(51) Int. Cl.

| | |
|---|---|
| ***B26B 19/38*** | (2006.01) |
| ***B26B 19/20*** | (2006.01) |
| ***B26B 19/06*** | (2006.01) |

(52) U.S. Cl.

CPC ..... *B26B 19/388* (2013.01); *B26B 19/06* (2013.01); *B26B 19/20* (2013.01)

(58) Field of Classification Search

None

See application file for complete search history.

(56) References Cited

U.S. PATENT DOCUMENTS

| | | | | |
|---|---|---|---|---|
| 7,876,472 | B2 | 1/2011 | Gudan et al. | |
| 8,474,466 | B2 * | 7/2013 | Lakin | B26B 19/00 132/213 |
| 9,731,424 | B1 * | 8/2017 | Holmes | A61B 17/8875 |
| 9,925,676 | B2 | 3/2018 | Krenik | |
| 10,226,872 | B2 | 3/2019 | Wilson | |
| 10,357,092 | B2 * | 7/2019 | Kustra | A45D 24/36 |
| 10,456,936 | B2 * | 10/2019 | Darwinkel | B26B 19/3886 |
| 10,576,647 | B2 * | 3/2020 | Uit De Bulten | A45D 26/00 |
| 10,646,016 | B2 | 5/2020 | Alvarez | |
| 2020/0031003 | A1 * | 1/2020 | Brown | B26B 19/046 |
| 2021/0170613 | A1 * | 6/2021 | Teteak | B26B 19/148 |

FOREIGN PATENT DOCUMENTS

WO 2015068068 A1 5/2015

* cited by examiner

*Primary Examiner* — Hwei-Siu C Payer

(74) *Attorney, Agent, or Firm* — Christopher Mayle; Bold IP, PLLC

(57) ABSTRACT

One or more embodiments of a hair cutting device which includes a hair cutting blade and a controller. The hair cutting blade includes a plurality of component blades configured to cut by moving in a first direction. A first component blade of the plurality of component blades is arranged to move independently from another component blade of the plurality of component blades in a second direction which is not parallel to the first direction. The controller is configured to control the hair cutting blade including movement of the first component blade of the plurality of component blades in the second direction.

20 Claims, 12 Drawing Sheets

HAIR CUTTING DEVICE

CROSS REFERENCE TO RELATED APPLICATIONS

This application claims priority to provisional application No. 63/051,060, which was filed 13 Jul. 2020, which is incorporated in its entirety.

FIELD OF THE DISCLOSURE

The present invention relates to devices for cutting hair.

BACKGROUND

Hair cutting devices generally require a skilled barber to cut a pattern into the hair of a person. Some attempts have been made to make hair cutting devices that can cut a programmed pattern into hair. However, these devices generally require sensors exterior to the hair cutting device to track the location of the cutting clipper on the head of the person. These exterior sensors may be bulky, expensive, and difficult to use.

SUMMARY

One or more embodiments are provided below for a device for cutting hair. The hair cutting device may include a hair cutting blade and a controller. The hair cutting blade may include a plurality of component blades configured to cut by moving in a first direction. A first of the plurality of component blades may be arranged to move independently from another plurality of component blades in a second direction which is not parallel to the first direction. The controller may be configured to control the hair cutting blade including movement of the first of the plurality of component blades in the second direction.

The device may provide significant advantages over the devices known in the art. The device may allow a person with very little training with cutting hair to cut a person's hair in a variety of selected patterns or styles by simply moving the device over the person's head.

Other advantageous features as well as other aspects and advantages of the invention will be apparent from the following description and the appended claims.

BRIEF DESCRIPTION OF THE DRAWINGS

Embodiments of the present disclosure are described in detail below with reference to the following drawings. These and other features, aspects, and advantages of the present disclosure will become better understood with regard to the following description, appended claims, and accompanying drawings. The drawings described herein are for illustrative purposes only of selected embodiments and not all possible implementations and are not intended to limit the scope of the present disclosure.

DETAILED DESCRIPTION

Figure 1:
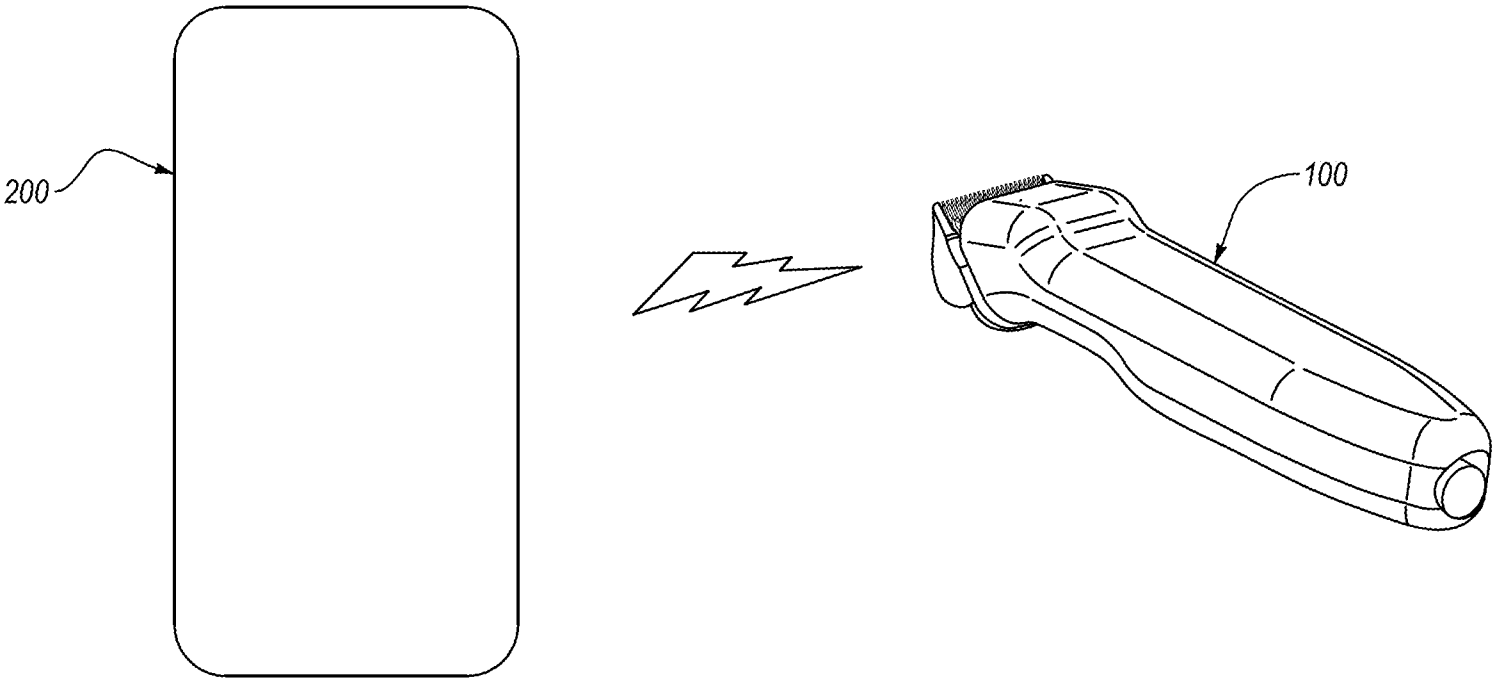
FIG. 1 shows an example system for programming a hair cutting device.

In the Summary above and in this Detailed Description, the claims below, and in the accompanying drawings, reference is made to particular features (including method steps) of the invention. It is to be understood that the disclosure of the invention in this specification includes all possible combinations of such particular features. For example, where a particular feature is disclosed in the context of a particular aspect or embodiment of the invention, or a particular claim, that feature can also be used, to the extent possible, in combination with and/or in the context of other particular aspects and embodiments of the invention, and in the invention generally.

The term "comprises" and grammatical equivalents thereof are used herein to mean that other components, ingredients, and steps, among others, are optionally present. For example, an article "comprising" (or "which comprises") components A, B, and C can consist of (i.e., contain only) components A, B, and C, or can contain not only components A, B, and C but also contain one or more other components.

Where reference is made herein to a method comprising two or more defined steps, the defined steps can be carried out in any order or simultaneously (except where the context excludes that possibility), and the method can include one or more other steps which are carried out before any of the defined steps, between two of the defined steps, or after all the defined steps (except where the context excludes that possibility).

The term "at least" followed by a number is used herein to denote the start of a range beginning with that number (which may be a range having an upper limit or no upper limit, depending on the variable being defined). For example, "at least 1" means 1 or more than 1. The term "at most" followed by a number is used herein to denote the end of a range ending with that number (which may be a range having 1 or 0 as its lower limit, or a range having no lower limit, depending upon the variable being defined). For example, "at most 4" means 4 or less than 4, and "at most 40%" means 40% or less than 40%. When, in this specification, a range is given as "(a first number) to (a second number)" or "(a first number)-(a second number)," this means a range whose lower limit is the first number and whose upper limit is the second number. For example, 25 to 100 mm means a range whose lower limit is 25 mm and upper limit is 100 mm.

Certain terminology and derivations thereof may be used in the following description for convenience in reference only and will not be limiting. For example, words such as "upward," "downward," "left," and "right" would refer to directions in the drawings to which reference is made unless otherwise stated. Similarly, words such as "inward" and "outward" would refer to directions toward and away from, respectively, the geometric center of a device or area and designated parts thereof. References in the singular tense include the plural, and vice versa, unless otherwise noted.

The term "coupled to" as used herein may mean a direct or indirect connection via one or more components.

Referring now to the drawings and the following written description of the present invention, it will be readily understood by those persons skilled in the art that the present invention is susceptible to broad utility and application. Many embodiments and adaptations of the present invention other than those herein described, as well as many variations, modifications, and equivalent arrangements will be apparent from or reasonably suggested by the present invention and the detailed description thereof, without departing from the substance or scope of the present invention. This disclosure is only illustrative and exemplary of the present invention and is made merely for purposes of providing a full and enabling disclosure of the invention.

FIG. 1 shows an example system 1000 for programming a hair cutting device 100. The system 1000 may include a hair cutting device 100 and an electronic device 200. The electronic device may be a cell phone, computer, or other similar device. The electronic device 200 may communicate with the hair cutting device 100 electronically. For example, the electronic device 200 and hair cutting device 100 may communicate over a wireless local area network such as Wi-Fi, over Bluetooth, or over a wired connection. Information such as hair cutting patterns or programming may be communicated between the devices.

Figure 2:
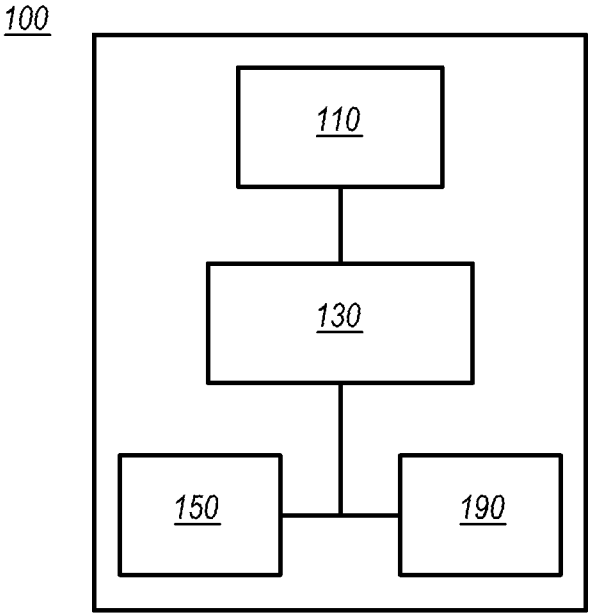
FIG. 2 shows an example schematic view of electronic components of a hair cutting device.

FIG. 2 shows an example schematic view of electronic components of a hair cutting device 100. The hair cutting device 100 may include a transceiver 110, a controller 130, motors and actuators 150, and sensors 190. The transceiver 110 may be configured to transmit and receive electronic communications to communicate with the electronic device 200. The controller 130 may be a processor and memory, a system on a chip, or other similar control circuitry adapted to control electronic components of a device. The controller 130 may be electronically connected to the transceiver 110, the motors and actuators 150, and the sensors 190 and be configured to control the transceiver 110, the motors and actuators 150, and the sensors 190.

Figure 3:
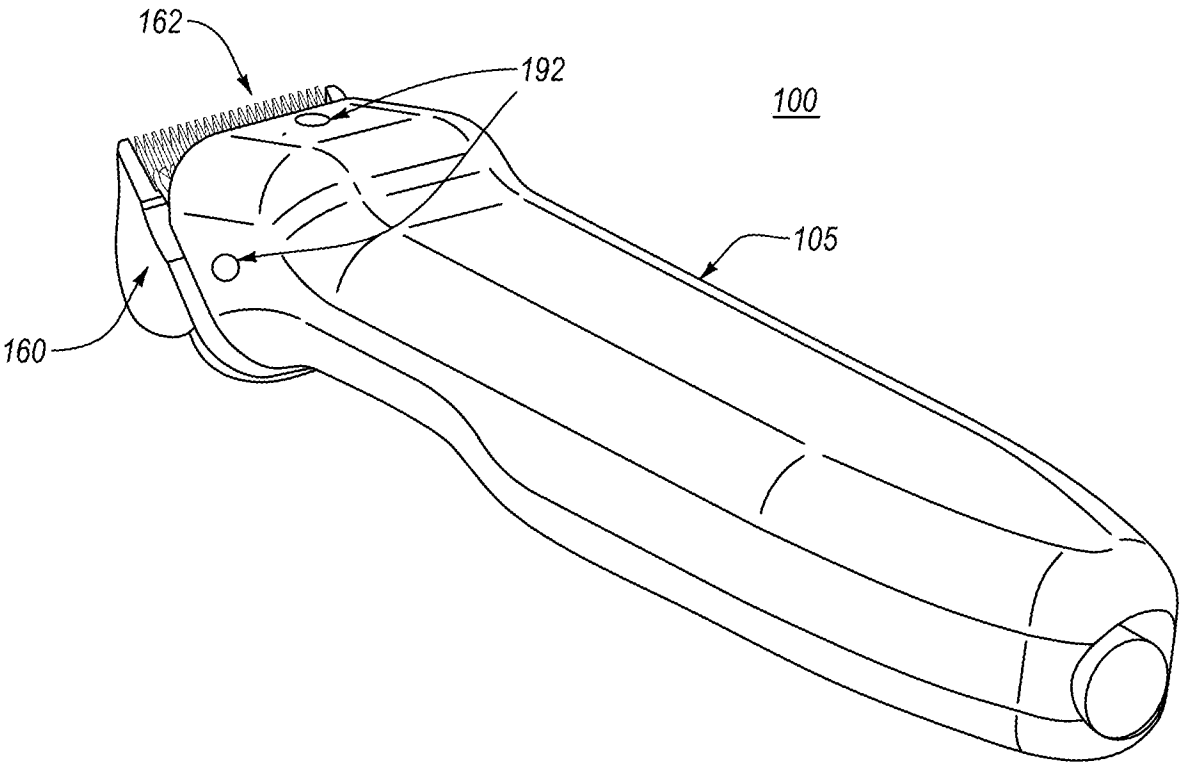
FIG. 3 shows an example exterior view of a first hair cutting device.

FIG. 3 shows an example exterior view of a first hair cutting device 100. The first hair cutting device 100 may include a case 105 with optical sensors 192 protruding through the case 105 and guard 160 with guard comb 162. The optical sensors 192 may be placed in several locations around the case 105 such that the optical sensors 192 can sense in most or all directions around the guard 160. The optical sensors 192 may be examples of the sensors 190. Other sensors such as pressure sensors and infrared sensors (not shown) may also be included.

Figure 4:
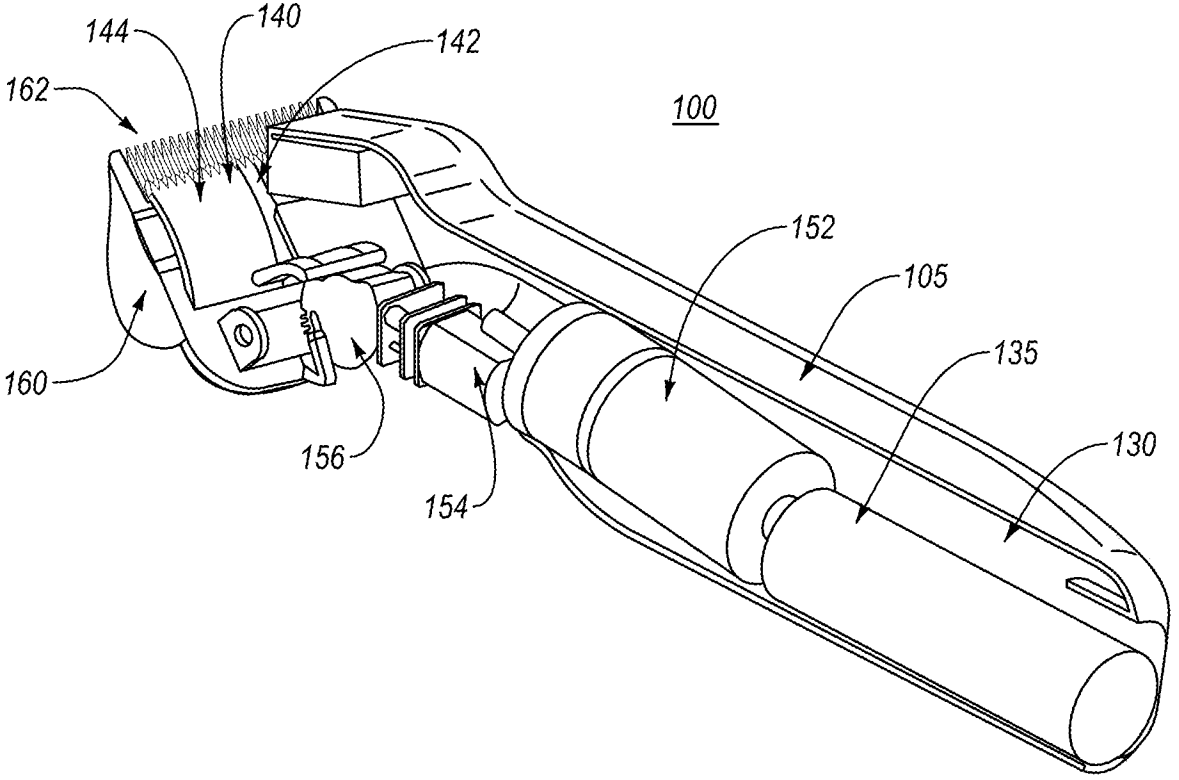
FIG. 4 shows an example cutaway view of a hair cutting device.

FIG. 4 shows an example cutaway view of a hair cutting device 100. The hair cutting device 100 may include a case 105 which is cutaway to show the interior of the hair cutting device 100. The hair cutting device 100 may also include controller 130, battery 135, blade motor 152, adjust motor 154, guard adjust mechanism 156, blade 140 and guard 160 with guard comb 162. The blade 140 may include composite blade 144 and carving blade 142. Other example blades 140 may also be used.

The blade motor 152 and adjust motor 154 may be examples of the motors and actuators 150.

The battery 135 may be configured to power the hair cutting device 100. The controller 130 may be configured to control the hair cutting device 100 and the other component parts of the hair cutting device 100. The blade motor 152 may be mechanically arranged to move the blade 140 in an oscillating motion across the guard comb 162. The adjust motor 154, is mechanically arranged to adjust the relative positioning of the guard comb 162 and the blade 140 and thus the length of hair being cut. The relative positioning of the guard comb 162 and the blade 140 is adjusted by adjusting a distance between a front end of the guard comb 162 and a position of the front end of the blade 140. The adjust motor 154 may adjust the position of the guard 160 and thus the position of the guard comb 162 by moving the guard adjust mechanism 156.

The guard 160 may be made of a combination of plastic and metal parts. The guard 160 may be connected to the guard adjust mechanism 156 and slidably connected to the blade 140. The guard comb 162 may include metal components that act with the blade 140 to cut hair that passes between teeth of the guard comb 162 when the blade 140 moves in an oscillating motion.

Figure 5:
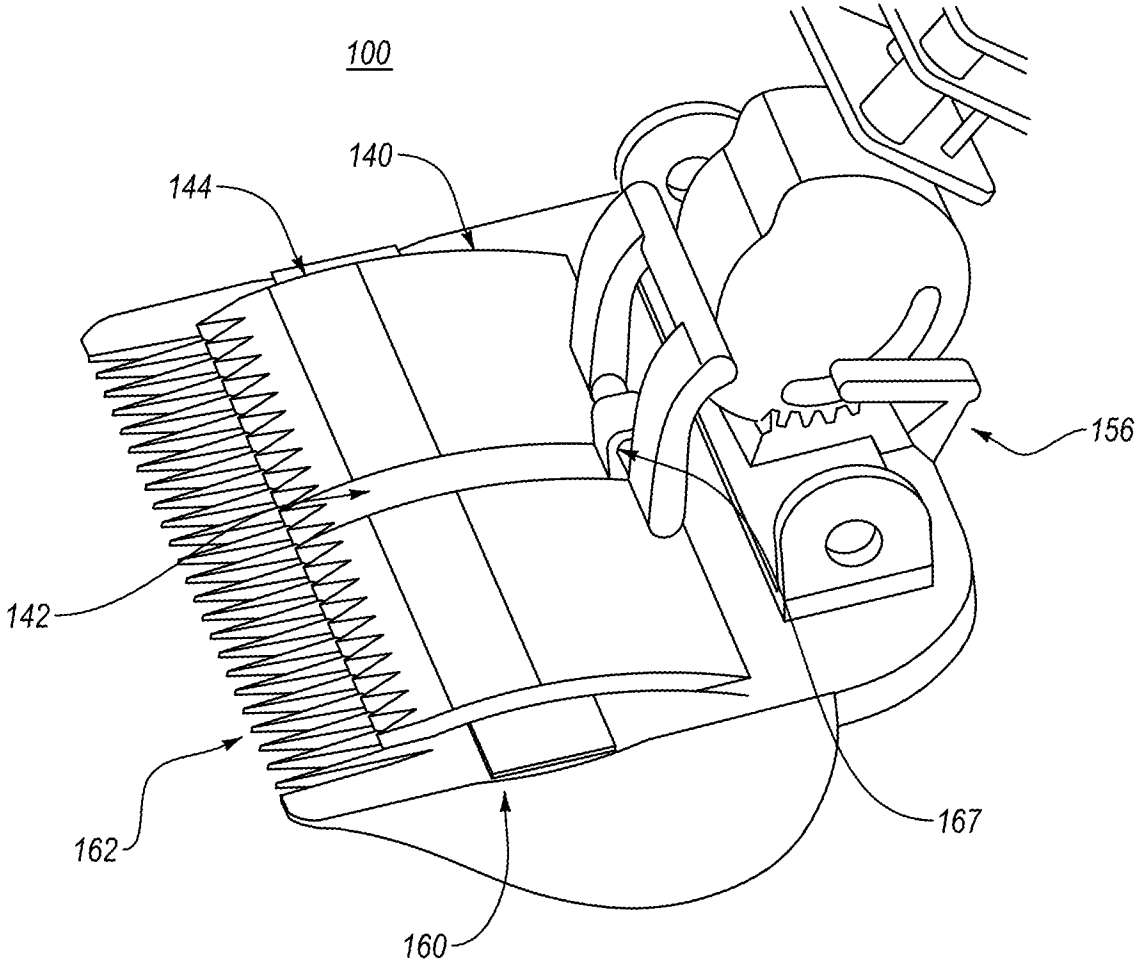
FIG. 5 shows an example view of a first front portion of a hair cutting device.

FIG. 5 shows an example view of a first front portion of a hair cutting device 100. The hair cutting device 100 may include a guard adjust mechanism 156, blade 140 with composite blade 144 and carving blade 142, carving blade actuator 167, and guard 160 with guard comb 162. The hair cutting device 100 may be an example of the hair cutting device 100.

The blade 140 may include a carving blade 142 and a two-part composite blade 144 on either side of the carving blade 142. The carving blade actuator 167 may move the carving blade 142 independently from the composite blade 144 to a position forward of the composite blade 144 (e.g., closer to the front end of the guard comb 162. The blade 140 may be about 3 cm wide and the carving blade 142 may be about 2.5 mm wide. By moving the guard 160 to a forward position, the composite blade 144 may be behind the guard comb 162 such that no hair will be cut by the composite blade 144. While the guard 160 is in the forward position, the carving blade 142 may be moved to a position forward of the composite blade 144 by the carving blade actuator 167 such that the carving blade 142 may cut hair when the blade 140 is oscillated.

Figure 6A:
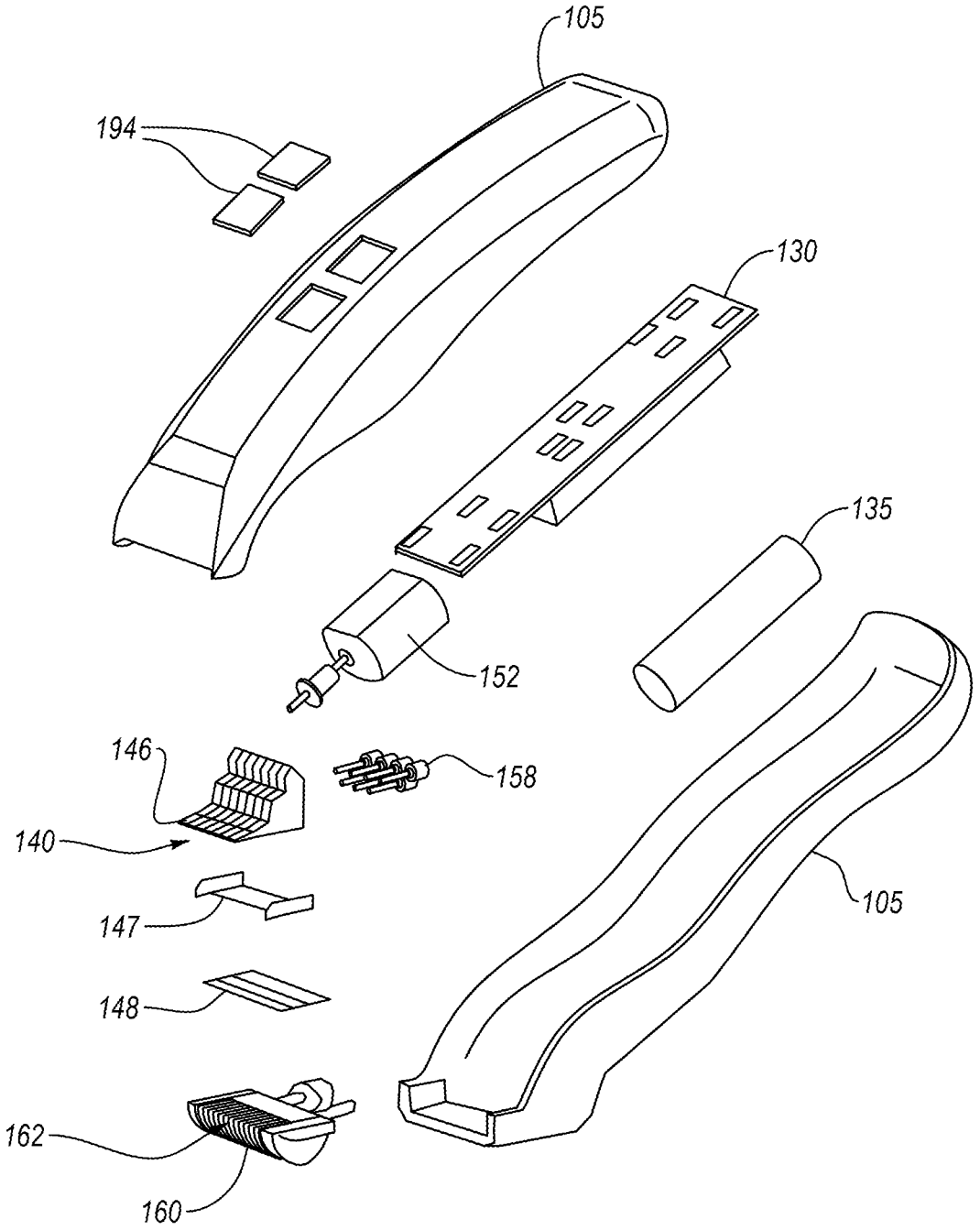
FIG. 6A shows an example exploded view of a second hair cutting device.

FIG. 6A shows an example exploded view of a second hair cutting device 100. The second hair cutting device 100 may include a case 105, a controller 130, a battery 135, a blade 140, a blade motor 152, an actuator array 158, a guard 160 with guard comb 162, and buttons 194. The blade 140 may include multi-blades (component blades) 146, horizontal slider 147, and horizontal sliding rail 148. The blade motor 152 may be configured to move the blade 140 horizontally (first direction) on the horizontal slider 147 which moves on the horizontal slider rail 148. The individual multi-blades 146 may be moved in a second direction not parallel (and in many embodiments perpendicular) to the horizontal direction (first direction) that the blade 140 is moved in by the blade motor 152. The horizontal sliding rail 148 may be between the guard 160 and the blade 140. The controller 130 may control the movement of the actuator array 158 and the blade motor 152 to control movement of the multi-blades 146 in the second direction and movement of the blade 140 in the first direction. The case 105 may hold all of the other components in place. The buttons 194 may receive input from a user to control the second hair cutting device.

Figure 6B:
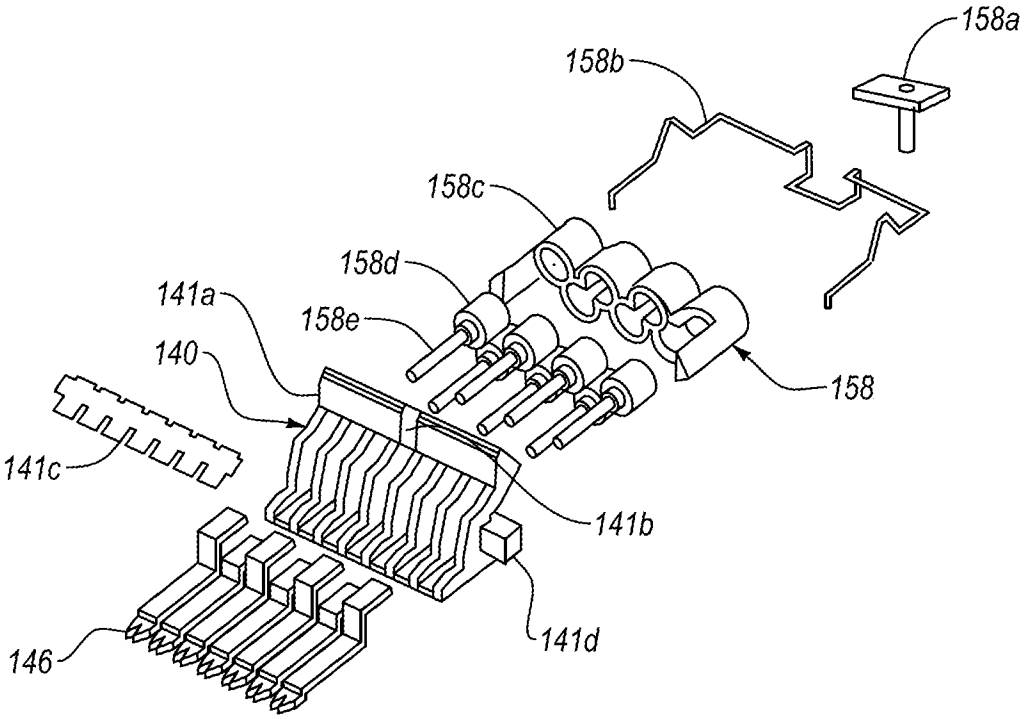
FIG. 6B shows an example exploded view of a hair cutting blade assembly of the second hair cutting device.

The case 105 may include molded plastic. The controller 130 may include a memory holding processor (or controller) readable instructions and a processor configured to execute the processor readable instructions. The processor readable instructions may include instructions for controlling the actuators (or actuator array) 158 based on a sensed location and orientation on the human head and a selected programmed hair style and the programmed hair style. The battery 135 may include a rechargeable battery or replaceable batteries. The blade 140 may include several components as described further below. The blade motor 152 may include an electric motor. The actuator array 158 may include various components and is further discussed below. The guard 160 with guard comb 162 may include molded plastic or another durable material. The buttons 194 may include electric input buttons with plastic covers that pass through the case 105. The multi-blades 146, horizontal slider 147, and horizontal sliding rail 148 may include metal or other durable materials. The guard 160 includes a top extending in the second direction. The multi-blades 146 may move in the second direction parallel to the top of the guard 160. Seven multi-blades 146 are shown in FIG. 6B. In some embodiments at least five multi-blades may be included.

Although, sensors 192 are not shown in FIG. 6A, sensors 192 similar to those shown in FIG. 3 may be used in combination with the controller 130 to sense a location of the device 100 on the human head. For example, data from the sensor 192 may be used by the controller 130 to determine a location and orientation of the device on the user's head, and based on the determined location, orientation, and a selected hair cutting pattern or style, control the movement of the actuators 158 to set the length that the hair on the head will be cut.

FIG. 6B shows an example exploded view of a hair cutting blade assembly of the second hair cutting device 100. The hair cutting blade assembly may include the actuators (or actuator array) 158 and blade 140 with the multi-blades 146. The actuator array 158 may include torsion spring loader 158*a*, torsion spring 158*b*, actuator holder 158*c*, actuators 158*d*, and lead screw 158*e*. The blade 140 may include multi blade holder 141*a*, connection rail 141*b*, upper multi-blade holder 141*c*, and connection points 141*d*.

The multi-blade holder 141*a* may be connected to the torsion spring 158*b* at the connection points 141*d* and may be pushed by the torsion spring 158*b* into the actuators array 158. The torsion spring loader 158*a* may hold the torsion spring 158*b* in place against the actuator holder 158*c* which is arranged to hold the actuators 158*d*. The torsion spring 158*b* also may press/return the multi-blades 146 back against the actuator array 158. Each actuator 158*d* may move a respective one of the multi-blades 146 by rotating a respective one of the lead screws 158*e* to change a length the respective threaded lead screw 158*e* extends from the actuator 158*d*. Each lead screw 158*e* may contact the non-cutting end (end opposite the cutting end) of a respective one of the multi-blades 146 and press against the respective multi-blade 146 to set the length of the multi-blade from the multi-blade holder 141*a*. The multi-blade holder 141*a* may connect to the blade motor 152 at the connection rail 141*b*. An extension from the blade motor 152 which is off center from the center of rotation of the blade motor 152 may enter a gap in the connection rail 141*b* and as the blade motor 152 spins the extension in a circular motion, the extension may press on the sides of the gap in the connector rail 141*b* and causes the multi-blade holder 141*a* to move side to side. The vertical movement of the extension as it rotates in a circular motion may cause the extension to move up and down in the gap but does not cause a significant motion of the multi-blade holder 141*a* up and down. The upper multi-blade holder 141*c* may connect to the multi-blade holder 141*a* and pass over the multi-blades 146 to secure the multi-blades vertically.

The actuators 158*d* may be arrayed in two rows, an upper row and a lower row. The actuators 158*d* may be arrayed in this way to conserve horizontal space so the multi-blades 146 may be closer together and smaller with the actuators 158*d* staggered between the upper row and the lower row. The multi-blades 146 may have horizontal portions, and vertical portions with heights of the vertical portions that correspond to the heights of the rows of actuators 158*d* such that the non-cutting end of each multi-blade 146 contacts the respective lead screw 158*e* of each respective actuator 158*d*.

The torsion spring loader 158*a*, may include a screw and other mounting elements such as plastic plates, washers, and the like used to secure objects together. The torsion spring 158*b* may include a shaped metal spring. The actuator holder 158*c* may include a durable molded plastic. The actuators 158*d* may include small electric motors controlled by the controller 130. The lead screws 158*e* may include threaded screws. The multi-blade holder 141*a* may include molded plastic or other durable materials. The connection rail 141*b* may include molded plastic or other durable materials and may be part of the same molded plastic as the multi-blade holder 141*a*. The upper multi-blade holder 141*c* may include plastic or metal or another durable material. The connection points 141*d* may include molded plastic and may be part of the same piece of molded plastic as the multi-blade holder 141*a*.

Figure 7:
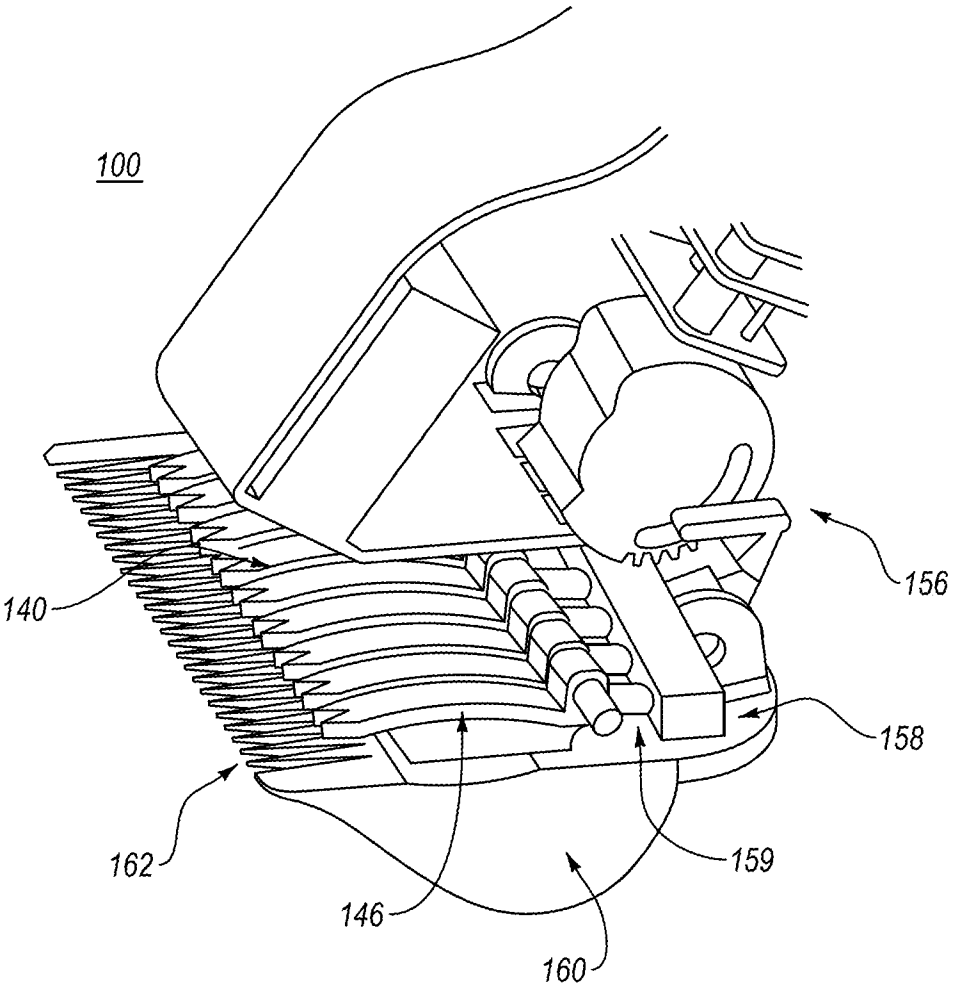
FIG. 7 shows an example view of a second front portion of a hair cutting device.

FIG. 7 shows an example view of a second front portion of a hair cutting device 100. The blade 140 may include a plurality of independently movable multi-blades 146. Each multi-blade 146 may be attached to a multi-blade actuator array 158 via an actuator arm 159. The multi-blade actuators 158 may be examples of the actuators and motors 150. Each actuator may be individually controlled to control the length of the individual multi-blades 146.

Figure 8:
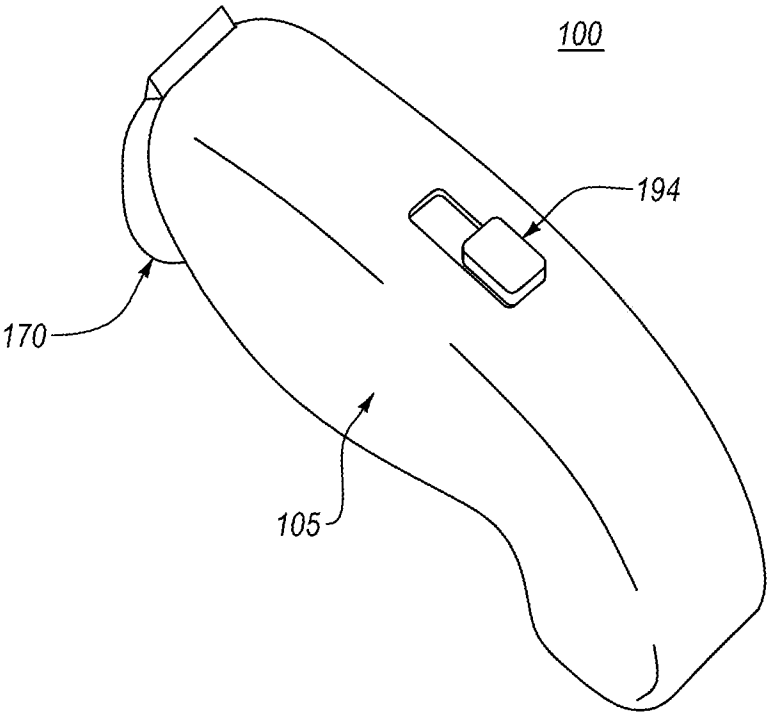
FIG. 8 shows an example exterior view of a third hair cutting device.

FIG. 8 shows an example exterior view of a third hair cutting device 100. The third hair cutting device 100 may include a cutting head 170 and a case 105 with button 194. The cutting head 170 may cover a section of the head of a person in order to cut the hair under the cutting head 170. For example, the cutting head 170 may cover an area of about 5 cm by 7 cm. The third hair cutting device 100 may be an example of the hair cutting device 100.

Figure 9B:
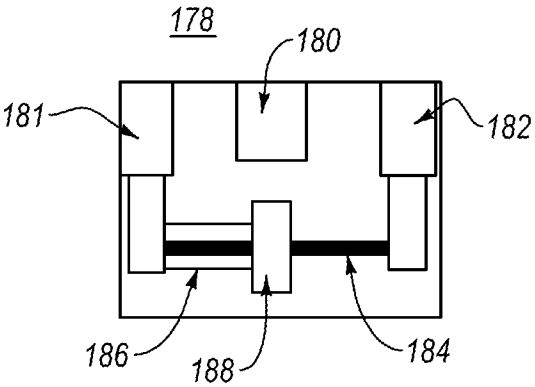
FIG. 9B shows an example movable blade holder for the cutting head.
Figure 9C:
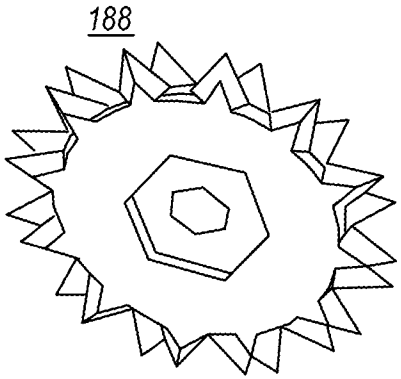
FIG. 9C shows an example blade for the blade holder.
Figure 9A:
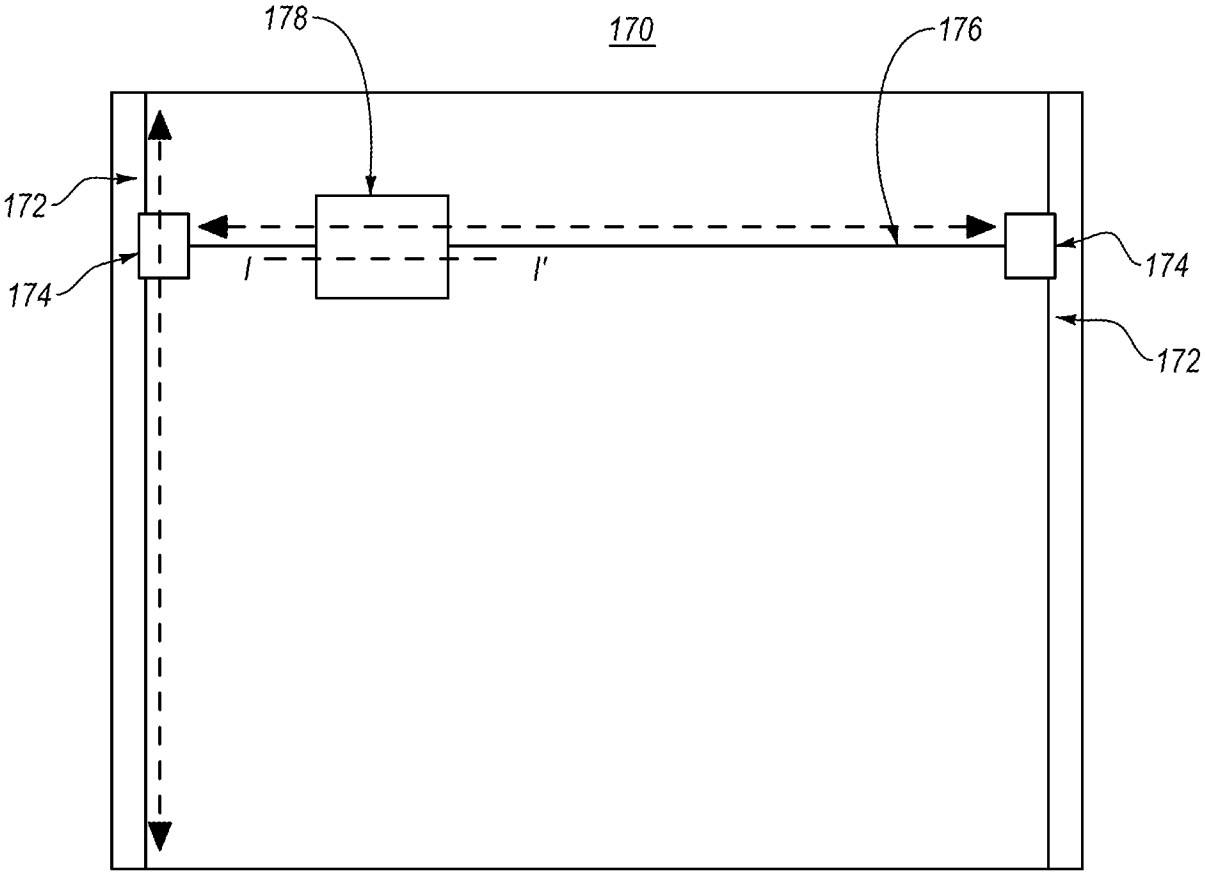
FIG. 9A shows an example cutting head of the third hair cutting device.

FIG. 9A shows an example cutting head 170 of the third hair cutting device 100. The cutting head 170 may include first rails 172, which extend in a first direction and a second rail 176 that extends in a second direction perpendicular to the first direction. The cutting head 170 may also include second rail moving actuators 174 and movable blade holder 178. The second rail moving actuators 174 may move along the first rails in order to move the second rail 176 in the first direction. The movable blade holder 178 may move along the second rail 176 in the second direction. The second rail moving actuators 174 may be examples of the motors and actuators 150.

FIG. 9B shows an example movable blade holder 178 for the cutting head 170. The movable blade holder 178 may include a blade holder actuator 180 configured to move the movable blade holder 178 in the second direction on the second rail 176. The movable blade holder 178 may also include a blade movement actuator 181, a blade height actuator 182, a blade securing axle 184, a blade driving axle 186, and a blade 188. The blade height actuator 182 may move the blade securing axle 184 which secures the blade 188, and thus move the blade 188 in a third direction perpendicular to the first direction and the second direction. Accordingly, the cutting head 170 may move the blade in three directions (e.g., three dimensions). The blade movement actuator 181 may cause the blade to move via the blade driving axle 186 in such a way that the blade 188 cuts hair that comes into contact with the blade 188.

FIG. 9C shows an example blade 188 for the blade holder 178. As shown, the blade 188 may include two parts which, when one part is moved, causes protrusions from the two parts to together perform a scissor-like cutting action. The blade driving axle 186 may be connected to one of the two parts to cause the part to move relative to the other part.

Figure 10:
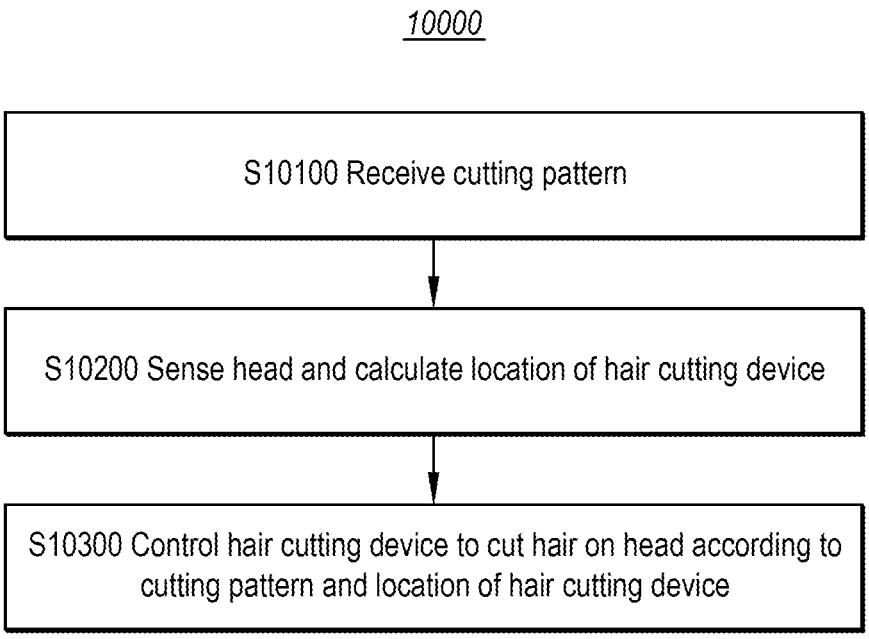
FIG. 10 shows an example first flow chart for cutting hair.

FIG. 10 shows an example first flow chart for cutting hair 10000. The first flow chart may be for cutting hair using the first hair cutting device 100. At step S10100, a cutting pattern may be received by the transceiver 110 and processed by the controller 130. The controller 130 may store a hair cutting pattern for later use. The cutting pattern may be an indication for a preprogrammed program in the controller 130 or may be instructions for controlling the various motors and actuators 150 based on the sensors' 190 input. The cutting pattern may indicate different positions for the guard 160 and the blade 140 components (e.g., the carving blade 142 and multi-blades 146) for cutting at different locations on the head. For example, a user may select a hair cutting pattern on the electronic device 200. The electronic device 200 may transmit the hair cutting pattern to the hair cutting device 100 and the hair cutting device 100 may receive the hair cutting pattern.

At step S10200, the sensors 190 such as the optical/visual sensors 192 may sense the head of the user and the controller 130 may calculate a position of the hair cutting device on the head. For example, the optical sensors 192 may be used by the controller 130 to detect a hairline of the head and the relative position of the hair cutting device 100 on the head based on the detected hairline. As another example, the optical sensors 192 may be used by the controller 130 to detect where hair has already been cut to determine the relative position of the hair cutting device 100.

At step S10300, the controller 130 may control the hair cutting device (e.g., the motors and actuators 150) to cut hair on the head according to the cutting pattern and location of the hair cutting device 100 on the head. For example, the controller 130 may use the sensors 190 to determine that the hair cutting device is at a first location (such as a sideburn, base of head, crown, or bangs) and first orientation (such as an orientation in three-dimensional space) and adjust the position of the guard 160 such that the hair is cut according to the hair cutting pattern. As the hair cutting device 100 is moved across the head the hair cutting device 100 may continue to determine the location and orientation of the hair cutting device 100 on the head and adjust the height of the guard 160 and/or position of the blade 140 components (e.g., the multi-blades 146 and carving blade 144) according to the determined position and orientation.

For example, the hair cutting device 100 may receive a hair cutting pattern with sides and back of the head being cut at 0.3 inches and the top being cut at 2 inches. The hair cutting device 100, as a user passes the hair cutting device 100 over a head, may continuously determine the location of the hair cutting device 100 on the head and adjust the guard so that the hair on the sides and back of the head are cut to 0.3 inches long and the hair on top of the head is cut to 2 inches long.

As another example, steps S10100-S10300 may be performed repeatedly for a single head such that the electronic device 200 may display instructions to a user while transmitting the hair cutting pattern to the hair cutting device 100 step by step. For example, the electronic device may display a first instruction to cut the lower portion of the back of the head, while at S9100 transmitting the hair cutting pattern for the back of the head to the hair cutting device 100. The hair cutting device 100 at S10200 may detect the location of the hair cutting device relative to the head. Then at S10300, the hair cutting device 100 may adjust the position of the guard 160 according to the sensed position and the hair cutting pattern. The hair cutting device 100 may automatically turn on the blade motor 152 when the controller 130 using the sensors 190 determines that the hair cutting device 100 is in the proper position to cut the hair according to the pattern. Steps S9100-S9300 may then be repeated for different parts of hair on the head with accompanying instructions being displayed by the electronic device 200.

Steps S11100-S11300 may be utilized to cut intricate patterns into the hair of the user using the carving blade 142 or the multi-blades 146. For example, the pattern may be cut into the hair using the multi-blades 146. The electronic device 200 may display instructions to cut a pattern in a section of hair (such instruction to move the hair cutting device 100 in parallel vertical lines on the side of the head above the ear) and, at S11100, transmit the hair cutting pattern for cutting the pattern in the hair above the ear. At S11200, the user may move the hair cutting device 100 over the area above the ear of the user while the hair cutting device 100 detects the position of the hair cutting device 100 relative to the head of the user (using the hair line and the areas of the hair that are already cut) and, at S11300, control the blade motor 152 and adjusts the position of the multi-blades 146 such that the pattern is cut into the hair.

Figure 11:
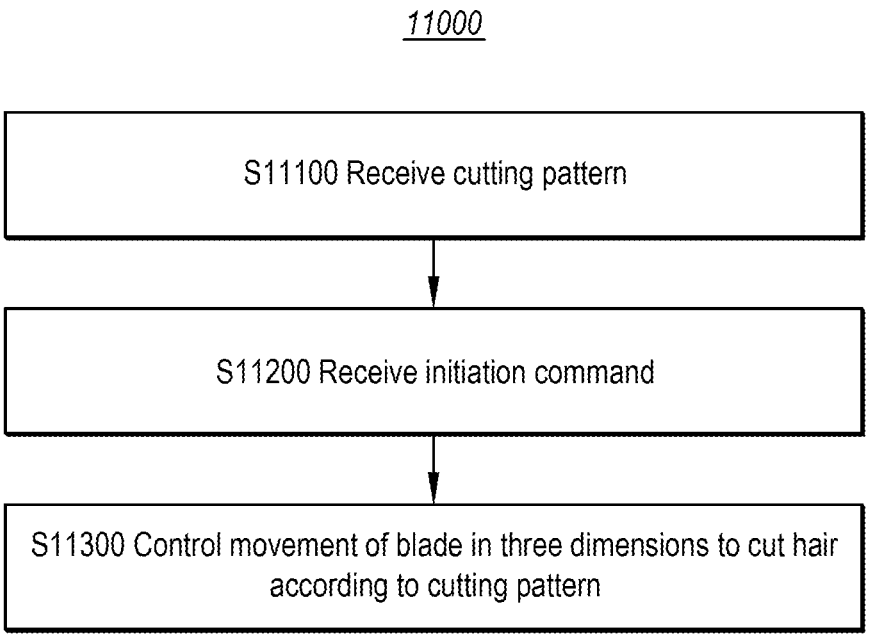
FIG. 11 shows an example second flow chart for cutting hair.

FIG. 11 shows an example second flow chart for cutting hair 11000. The second flow chart for cutting hair 11000 may be used to cut hair using the third hair cutting device 100. At step S11100, the hair cutting device 100 may receive a hair cutting pattern from an electronic device 200. The hair cutting pattern may be a pattern expressed as locations in an x-y plane (first and second directions) and height z (third direction) for the blade 188 to cut the hair at each location. The pattern may also be expressed as instructions on how to move the blade 188 in the first, second, and third directions.

At step S11200, an initiation command may be given by a user. For example, by pressing the button 194. In some embodiments, the user should place the cutting head 170 on the section of hair to be cut before pressing the button 194. In other embodiments, a pressure sensor (not shown) may be used to ensure that the contact is maintained while the hair is being cut.

At step S11300, the controller 130 may control movement of the blade 188 in three dimensions (first, second, and third directions) to cut hair according to the cutting pattern. The blade may be moved in a plowing pattern starting at one end in the first direction moving across in the second direction (while adjusting in the third −z direction for the cutting height at each location in the x-y plane) then moving slightly away from the end in the first direction and returning in the second direction (again while adjusting in the third direction). The user should hold the hair cutting device very still against the head of the user during the step S10300.

Accordingly, very intricate patterns may be cut into hair with a user of a hair cutting device 100 only having to follow very basic instructions which requires very little experience and training. Furthermore, sensors exterior to the hair cutting device are not needed.

Many different embodiments of the inventive concepts have been shown. A person of ordinary skill in the art will appreciate that the features from different embodiments may be combined or replaced with other features from different embodiments.

The device 100 provides significant advantages over the devices known in the art. The device 100 may allow a person with very little training with cutting hair to cut a person's hair in a variety of selected patterns or styles by simply moving the device over the person's head.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description but is not intended to be exhaustive or limited to the invention in the form disclosed. Many modifications and variations will be apparent to those of ordinary skill in the art without departing from the scope and spirit of the invention.

The embodiments were chosen and described in order to best explain the principles of the invention and the practical application, and to enable others of ordinary skill in the art to understand the invention for various embodiments with various modifications as are suited to the particular use contemplated. The present invention according to one or more embodiments described in the present description may be practiced with modification and alteration within the spirit and scope of the appended claims. Thus, the description is to be regarded as illustrative instead of restrictive of the present invention.

What is claimed is:

1. A hair cutting device comprising:

a hair cutting blade including a plurality of component blades and configured to cut by moving in a first direction, wherein a first component blade of the plurality of component blades is arranged to move independently from a second component blade of the plurality of component blades in a second direction which is not parallel to the first direction, a controller configured to control the hair cutting blade including movement of the first component blade of the plurality of component blades in the second direction.

2. The hair cutting device of claim 1 further comprising:

an actuator configured to be controlled by the controller to move the first component blade of the plurality of component blades in the second direction.

3. The hair cutting device of claim 2, further comprising:

one or more sensors configured with the controller to detect a location of the cutting device relative to a human head.

4. The cutting device of claim 3, wherein the one or more sensors are optical/visual sensors and the one or more sensors together with the controller are configured to detect a hairline of the human head.

5. The hair cutting device of claim 3, wherein the actuator moves the first component blade of the plurality of component blades by rotating a threaded shaft.

6. The hair cutting device of claim 3, the controller further comprising:

a memory storing controller readable instructions for controlling the hair cutting device.

7. The hair cutting device of claim 6, wherein the controller readable instructions include instructions for controlling the actuator based on a sensed location on the human head and a programmed hair style.

8. The hair cutting device of claim 6, wherein the controller readable instructions include the programmed hair style.

9. The hair cutting device of claim 6, further comprising:

a motor configured to move the plurality of component blades in the second direction; and a battery configured to provide power to the motor, the actuator, the one or more sensors, the controller, and the memory.

10. The hair cutting device of claim 6, further comprising:

a guard including a top extending in the second direction, wherein the first component blade of the plurality of component blades moves parallel to the top of the guard in the second direction.

11. The hair cutting device of claim 2, wherein the controller is configured to control the actuator to move the first component blade of the plurality of component blades based on a sensed location of the hair cutting device on a human head.

12. The hair cutting device of claim 1, further comprising:

a plurality of actuators configured to each move a respective component blade of the plurality of component blades.

13. The hair cutting device of claim 12, wherein the plurality of component blades includes at least five component blades.

14. The hair cutting device of claim 12, wherein the plurality of actuators is arranged in at least two rows.

15. The hair cutting device of claim 14, wherein each of the plurality of component blades includes a horizontal portion and a vertical portion.

16. The hair cutting device of claim 1, wherein the second direction is perpendicular to the first direction.

17. A hair cutting device comprising:

a hair cutting blade including a plurality of component blades and configured to cut by moving in a first direction, wherein each component blade of the plurality of component blades is arranged to move independently from other component blades of the plurality of component blades in a second direction which is not parallel to the first direction, a controller configured to control the hair cutting blade including movement of the plurality of component blades in the second direction.

18. The hair cutting device of claim 17, further comprising:

a plurality of actuators configured to each move a respective component blade of the plurality of component blades in the second direction.

19. The hair cutting device of claim 18 further comprising:

a motor configured to move the plurality of component blades in the second direction;

a sensor configured with the controller to sense a location of the hair cutting device on a human head; and a battery configured to provide power to the motor, the plurality of actuators, the sensor, and the controller.

20. The hair cutting device of claim 17, wherein the plurality of component blades includes at least five component blades.

* * * * *